United States Patent [19]

Ghorashi

[11] Patent Number: 4,883,496

[45] Date of Patent: Nov. 28, 1989

[54] PROCESS FOR DYEING CRYSTALLINE AROMATIC POLYAMIDE FIBERS WITH WATER-INSOLUBLE DYES

[75] Inventor: Hamid M. Ghorashi, Midlothian, Va.

[73] Assignee: E. I. Du Pont de Nemours and Company, Wilmington, Del.

[21] Appl. No.: 290,870

[22] Filed: Dec. 30, 1988

Related U.S. Application Data

[63] Continuation-in-part of Ser. No. 156,694, Feb. 14, 1988, abandoned.

[51] Int. Cl.[4] ..... D06P 5/00; D06P 7/00

[52] U.S. Cl. ..... 8/476; 8/149.3; 8/151; 8/493; 8/497; 8/925; 264/178 F

[58] Field of Search ..... 8/476, 493, 497

[56] References Cited

U.S. PATENT DOCUMENTS

| | | | |
|---|---|---|---|
| 3,133,138 | 5/1964 | Alexander | 264/235.6 |
| 3,287,324 | 11/1966 | Sweeny | 528/348 |
| 3,558,267 | 1/1971 | Langenfeld | 8/586 |
| 3,888,821 | 6/1975 | Milford | 264/182 |
| 4,710,200 | 12/1987 | Cates et al. | 8/574 |
| 4,755,335 | 7/1988 | Ghorashi | 264/48 |

FOREIGN PATENT DOCUMENTS 1438067 6/1976 United Kingdom .

*Primary Examiner*—A. Lionel Clingman

[57] ABSTRACT

A process for dyeing crystalline poly(meta-phenylene isophthalamide) fibers with a water-insoluble dye padded onto such fibers by heating with steam at critical temperatures first to activate the dye and thereafter to diffuse it into the fibers.

6 Claims, No Drawings

PROCESS FOR DYEING CRYSTALLINE AROMATIC POLYAMIDE FIBERS WITH WATER-INSOLUBLE DYES

This application is a continuation-in-part of application Ser. No. 156,694 filed Feb. 17, 1988, now abandoned.

BACKGROUND OF THE INVENTION

1. Field of the Invention

The field of art to which this invention pertains is aromatic polyamide fibers and, more particularly, it is directed to processes for dyeing such fibers.

Specifically, such invention is a process for dyeing a fiber structure or tow of crystalline poly(meta-phenylene isophthalamide) fibers or filaments with a water-insoluble dye padded onto the filaments. The tow is heated with steam at a temperature below the glass transition temperature of the poly-(m-phenylene isophthalamide) but above the dye-activation temperature of the dye to activate the dye material on the surface of the filaments of the tow, and, thereafter, it is heated with steam at a temperature above the glass transition temperature of the poly(m-phenylene isophthalamide) but no more than about 165° C. to diffuse substantially all of the dye material into the filaments of the tow.

Preferably the tow is heated to a maximum temperature of from about 150° to 165° C.

By following the process of this invention crystalline poly(meta-phenylene isophthalamide) filaments may be efficiently dyed in a short period of time with water-insoluble dyes, without the use of carriers or swelling agents, at relatively low temperatures, e.g., below 165° C., without degradation of the dye material.

2. Description of the Related Art

Aromatic polyamide fibers are well known to the art. They have high tensile strength, are flame and heat resistant, possess good flex life, and have high melting points which make them particularly suited to be formed into fabrics usable as protective clothing, and for many other uses.

It further is known that while such aromatic polyamide fibers possess many desired properties as manufactured they also require, for given uses, that various steps be taken to improve a property or properties of the fibers to meet a specific end use. As an example, various additives such as dyes, ultraviolet light screeners, flame retardants, antistatic agents or water repellents, may be incorporated into the fibers during basic manufacture or in subsequent processing steps to improve their performance levels.

This invention is specifically directed to aromatic polyamide fibers of a poly(meta-phenylene isophthalamide) polymer, hereinafter referred to as "MPD-I fibers". Such fibers, which are described in greater detail in U.S. Pat. No. 3,287,324 to Sweeny, for example, possess many useful properties. It is well known to the art, however, that these fibers are difficult to dye.

Various techniques have evolved to solve this dyeing problem. Typical solutions, for example, are more fully described in copending applications Ser. No. 910,941, filed Sept. 26, 1986, and Ser. No. 055,394, filed May 29, 1987, which applications are incorporated herein by reference.

The inventions of these copending applications solve various problems found in the prior art by surprisingly finding that by heating as-spun, never-dried, water-swollen, or still moist to the touch, MPD-I fibers with steam, heated within certain temperature ranges, it is possible to effectively dye the fibers. Specifically, it has been found that such fibers may be dyed, using a water-soluble dye, by heating the fibers with steam heated at a temperature from about 110° C. to 140°C. for a time sufficient to diffuse the dye into the open pores of the fibers. A water-insoluble material, such as an ultraviolet light screen or a disperse dye, may also be mixed with the water-soluble dye, and driven into the fibers by heating with steam at sublimation temperatures from about 110° C. to 150° C.

It further has been found that these fibers may be subsequently heated, again with steam, at a temperature of about 165° C. to collapse the fibers and lock the dye in place. This latter step will also crystallize the fibers and stabilize them against progressive laundry shrinkage.

Another solution to this dyeing problem is shown in British Pat. No. 1,438,067 to Moulds and Vance which teaches imbibing a polyoxyethylene laurate impregnant into never-dried MPD-I fibers, prior to dyeing. The impregnant serves as a "structure prop" which prevents collapse of the water-swollen fibers on drying. The dried fibers may subsequently be readily tinted in an aqueous dye bath while corresponding fibers dried without the impregnant may be tinted only under much more vigorous conditions, including necessarily the use of dye carriers, such as acetophenone.

This invention essentially involves a process for dyeing MPD-I fibers, in crystalline form. These fibers are particularly difficult to dye.

Again, various processes have evolved for producing crystalline MPD-I fibers in various colors. In one such process the dye is incorporated into the spinning solution prior to extrusion of the fibers through orifices in a spinneret, in a basic procedure well known to the art. The fibers are then crystallized.

In this process, the fibers are exposed to very high temperatures during crystallization and the spun-in dyes must be stable at the high temperatures involved. Only a few dyes, mainly certain acid dyes, are sufficiently stable for use as spun-in dyes.

The limitations on the type of dye which may be used to dye MPD-I fibers have also been addressed by the art. For Example, U.S. Pat. Nos. 3,558,267 to Langenfeld and 4,710,200 to Cates et al. disclose that almost any conventional dyestuff can be used to dye MPD-I fibers, including crystalline MPD-I fibers, by making a solution of the dye in a liquid which is a solvent or strong swelling agent for the fiber, or in concentrated aqueous solution of the liquid, and heating the fiber in the resulting solution. The problem with this approach to coloring crystalline MPD-I fibers is that the fiber properties are usually adversely affected by the solvent or swelling agent. Also, recovery of the liquid remaining after dyeing or disposing of it in a non-polluting manner is a problem.

Lastly, in the art, the prime conventional method that has evolved for dyeing uncolored, crystalline MPD-I fibers has been to dye them with cationic dyes (water-soluble dyes which are also called "basic" dyes) in a pressure vessel using an aqueous dyebath containing several percent of a swelling agent (usually called a "carrier") at a temperature of about 121° C. This approach has had limitations in that cationic dyes are the only ones suitable for use in dyeing MPD-I fibers from a substantially aqueous solution, and several hours are usually required to achieve the depth of color desired. Further, the disposal of the residual dyebath containing swelling agent in a non-polluting manner is a problem. Also, this method is more suitable for dyeing fabric than for dyeing tow.

Accordingly, a process has long been sought for dyeing crystalline MPD-I tow using disperse dyes or other dyes which cannot currently be applied to MPD-I fibers from substantially aqueous dyebaths to obtain a wide range of colors and retain good fiber properties. It has been especially desired to achieve a process for applying such dyes at relatively low temperature, e.g., 165° C. or less, since many otherwise desirable dyes are unstable at higher temperatures. And, it further has been desired to be able to dye crystalline MPD-I tow continuously within a relatively short time, e.g., 30 minutes or less.

This invention solves these and other problems found in the prior art by surprisingly finding that by heating crystalline MPD-I fibers with steam, heated within certain temperature ranges, it is possible effectively to dye the fibers. Specifically, it has been found that such crystalline fibers may be dyed with a water-insoluble dye by heating the tow with steam at a temperature below the glass transition temperature of poly(m-phenylene isophthalamide), e.g., the MPD-I fibers, but above the dye-activation temperature of the dye to activate the dye material padded onto the surface of the fibers or filaments of the tow, and thereafter heating the tow with steam at a temperature above the glass transition temperature of the MPD-I fibers but no more than about 165° C. to diffuse substantially all of the dye material into the filaments of the tow. Preferably the tow is heated to a maximum temperature of from about 150° to 165° C. and is dyed in a very short period of time, (e.g., less than 30 minutes) with no residual disposal problem. In so doing the process of this invention provides the art with an effective, improved means of dyeing crystalline MPD-I fibers with a large variety of dyestuff.

SUMMARY OF THE INVENTION

Briefly described, this invention is a process for dyeing a tow of crystalline poly(m-phenylene isophthalamide) filaments or fibers comprising the steps of:

padding onto the surface of the filaments of the tow an aqueous dispersion of 1 to 20 wt. % of a water-insoluble dye material having a dye-activation temperature below the glass transition temperature of poly(m-phenylene isophthalamide), heating the tow with steam to a temperature below the glass transition temperature of the poly(m-phenylene isophthalamide) but above the dye-activation temperature to activate the dye material on the surface of the filaments of the tow, and thereafter heating the tow with steam to a temperature above the glass transition temperature of the poly(m-phenylene isophthalamide) but no more than about 165° C. to diffuse substantially all of the dye material into the filaments of the tow.

Preferably, an aqueous dispersion of 2 to 20 wt. % of a water-insoluble dye material is padded onto the surface of the filaments and the tow is heated to a maximum temperature of from about 150° to 165° C. The dyeing process takes no longer than 30 minutes and does not require the use of a carrier.

Description of the Preferred Embodiments

This invention is an improved process for dyeing aromatic polyamide fibers.

More specifically, in the processes of this invention, a water-insoluble dye is diffused into a fiber structure of crystalline MPD-I synthetic fibers to improve their properties.

As just stated, the fibers with which the present invention are concerned are crystalline poly(m-phenylene isophthalamide) (MPD-I) fibers, which are available commercially. The preparation of the polymer, poly(m-phenylene isophthalamide), is disclosed in U.S. Pat. No. 3,287,324 to Sweeny, which also discloses preparation of spinning solutions of the polymer and extrusion of the spinning solutions into fibers, followed by orientation of the fibers. The polymer primarily comprises repeating structural units of m-phenylene isophthalamide, but may also contain minor amounts of other aromatic polyamide structural units such as m-phenylene terephthalamide units. The term "fiber", as used herein, includes continuous filaments, which may be in the form of a tow containing a large number of filaments.

The invention is directed to a process for dyeing these MPD-I fibers after they have been crystallized. The stretching and heat crystallization of fibers spun from MPD-I polymer are disclosed in U.S. Pat. No. 3,133,138 to Alexander. These crystalline MPD-I fibers are more difficult to dye than amorphous (non-crystalline) MPD-I fibers, especially when relatively dilute dye solutions or dispersions are used, as is customary in conventional dyeing operations. In accordance with the present invention, a relatively concentrated (1–20, preferably 2–20 wt. %) dispersion of a water-insoluble dye is coated onto the surface of the crystalline MPD-I filaments and dyed into the filaments at a relatively low temperature (165° C. or less) in an atmosphere of saturated steam within a relatively short contact time.

Water-insoluble dyes having a dye-activation temperature below the glass transition temperature of MPD-I, using the dye-activation temperature test described below, are employed in the proess of this invention. Most of the usable dyes are known in the trade as disperse dyes (e.g., C. I. Disperse Violet 33 dye). These dyes are exemplary of dyes which may be used.

Test: Establishing that dye-activation temperature is below glass transition temperature of MPD-I.

For the purposes of this invention it is determined whether any given dye has a dye-activation temperature below the glass transition temperature of MPD-I by determining whether a tow of never-dried MPD-I amorphous filaments is dyed in steam by the given dye. The never-dried MPD-I filaments, which are porous and water-swollen, undergo a change at the glass transition temperature of MPD-I in which the pores in the filaments collapse. In steam this occurs at about 150° C. In the dye-activation temperature test, the never-dried MPD-I filaments, with an aqueous dispersion or solution of dye padded onto the filaments, is heated in steam below the temperature at which the pores collapse. The still-porous filaments are then cooled, washed with water, and examined to see whether the filaments have become dyed. The never-dried filaments with the dye padded upon them are preferably heated to 130° C. for 15 minutes, although a somewhat higher temperature can be used, so long as the pores of the never-dried MPD-I filaments do not become collapsed, if it appears that the dye-activation temperature of the dye is somewhat above 130° C. The tow of never-dried MPD-I filaments is made as described in Part A of Example 1 of copending U.S. patent application Ser. No. 910,941, which is incorporated by reference herein.

The dye-activation temperature determinations for the specific dyes referred to in the Examples is described below:

C. I. Disperse Violet 33. A 120-kilotex (1,100,000 denier) tow of never-dried MPD-I filaments having a linear density of about 1.9 decitex (dtex) (1.7 dpf) was padded with an aqueous dispersion of 25 g/L of C. I. Disperse Violet 33 dye (a water-insoluble dye), with 6 g/L of guar gum thickener also added to the dispersion, by feeding the tow between nip rolls at the rate of 12 m/min at a pressure 203 kPa (two atmospheres) with the aqueous dispersions contained above the nip rolls. The tow, padded with the aqueous dispersion so that the individual filaments were coated with the dispersion, was then passed into a steam chamber wherein it was exposed to saturated steam at a temperature of 130° C. for 15 minutes. Upon leaving the chamber, the tow was washed with water. It was observed that very good exhaustion of the dye into the filaments was obtained, so that the tow was dyed to a deep shade of violet. It was concluded that the Disperse Violet 33 dye was at or above its dye-activation temperature at 130° C.

C. I. Disperse Blue 56. The procedure for C. I. Disperse Violet 33 as repeated, except that the tow of never-dried MPD-I filaments was padded with an aqueous disperson of 25 g/L of C. I. Disperse Blue 56 dye (a water-insoluble dye) and 6 g/L of guar gum thickener. After the tow was exposed to saturated steam at a temperature of 130° C. for 15 minutes and then was washed with water, it was observed that the tow was dyed to a deep shade of blue. It was concluded that the Disperse Blue 56 dye was at or above its dye-activation temperature at 130° C.

C. I. Disperse Blue 79. The procedure for C. I. Disperse Violet 33 was repeated again, except that the tow of never-dried MPD-I filaments was padded with an aqueous dispersion of 25 g/L of C. I. Disperse Blue 79 dye (a water-insoluble dye) and 6 g/L of guar gum thickener. After the tow was exposed to saturated steam at a temperature of 130° C. for 15 minutes and then was washed with water, it was observed that the tow was dyed to a deep shade of blue. It was concluded that the Disperse Blue 79 dye was at or above its dye-activation temperature at 130° C.

C. I. Disperse Yellow 42. The procedure for C. I. Disperse Violet 33 was repeated again, except that the tow of never-dried MPD-I filaments was padded with an aqueous dispersion of 25 g/L of C. I. Disperse Yellow 42 dye (a water-insoluble dye) and 6 g/L of guar gum thickener. After the tow was exposed to saturated steam at a temperature of 130° C. for 15 minutes and then was washed wtih water, it was observed that the tow was dyed to a deep shade of yellow. It was concluded that the Disperse Yellow 42 dye was at or above its dye-activation temperature at 130° C.

C. I. Disperse Red 60. The procedure for C. I. Disperse Violet 33 was repeated again, except that the tow of never-dried MPD-I filaments was padded with an aqueous dispersion of 25 g/L of C. I. Disperse Red 60 dye (a water-insoluble dye) and 6 g/L of guar gum thickener. After the tow was exposed to saturated steam at a temperature of 130° C. for 15 minutes and then was washed with water, it was observed that the tow was dyed to a deep shade of red. It was concluded that the Disperse Red 60 dye was at or above its dye-activation temperature at 130° C.

C. I. Basic Red 29. Using the same general procedure described above for C. I. Disperse Violet 33 dye, a 120-kilotex tow of never-dried MPD-I filaments was padded with an aqueous solution of 25 g/L of C. I. Basic Red 29 dye (a water-insoluble dye) containing 6 g/L of guar gum thickener at the rate of 12 m/min and at a pressure of 203 kPa. The tow, padded with the aqueous solution, was passed into the steam chamber wherein it was exposed to saturated steam at 130° C. for 15 minutes. It was observed that very good exhaustion of the dye into the filaments was obtained, so that the tow was dyed to a deep shade of red. It was concluded that the Basic Red 29 dye was at or above its dye-activation temperature at 130° C.

Briefly described, the glass transition temperature ($T_g$) of a polymeric fiber is a characteristic of the amorphous phase of the polymer of which the fiber is made. Below the glass transition temperature, which is a relatively narrow temperature range rather than a sharply defined temperature, the fiber tends to remain in the same structural configuration in which it was originally formed. Above the glass transition temperature, the fiber readily undergoes such changes in structure as relaxation of stresses, collapse of pores within the fiber, and crystallization of the polymer of which the fiber is made. For poly(meta-phenylene isophthalamide) in saturated steam, the glass transition temperature is about 150° C.

EXAMPLE 1

A 60-kilotex (550,000 denier) tow of crystalline MPD-I filaments having a linear density of about 1.65 decitex (1.5 dpf) (available as Type 450 Nomex® aramid fiber from E. I. du Pont de Nemours & Co., Inc.) was padded with an aqueous dispersion of 25 g/L of C. I. Disperse Violet 33 dye (a water-insoluble dye) containing 6 g/L of guar gum thickener by feeding the tow between nip rolls at the rate of 12 m/min at a pressure of 203 kPa (two atmospheres) with the aqueous dispersion contained above the nip rolls. The pick-up of the aqueous dispersion on the tow was about 50 wt. %, based on the dry weight of the tow. The tow, padded with the aqueous dispersion so that the individual filaments were coated with the dispersion, was then exposed to saturated steam in a steam chamber. At the beginning of the exposure the tow was at ambient temperature. The saturated steam was at a temperature of 165° C. As the tow was heated by the steam, its temperature increased, passing through the dye-activation temperature of the C. I. Disperse Violet 33 dye, and then above the glass transition temperature of the MPD-I tow. After a total exposure time of 15 minutes, the tow was washed with water. It was observed that very good exhaustion of the dye into the filaments was obtained, so that the tow was dyed to a deep shade of violet.

EXAMPLE 2

Example 1 was repeated, except that the tow of crystalline MPD-I filaments was padded with an aqueous dispersion of 25 g/L of C. I. Disperse Yellow 42 dye (a water-insoluble dye) containing 6 g/L of guar gum thickener. After a total exposure time of 15 minutes to the saturated steam at a temperature of 165° C., the tow was washed with water. It was observed that very good exhaustion of the dye into the filaments was obtained, so that the tow was dyed to a deep shade of yellow.

COMPARATIVE EXAMPLES

Examples 1 and 2 were repeated, except that saturated steam at a temperature of only 130° C. was used. After a total exposure time of 15 minutes at 130° C., the tow was washed with water. Most of the dyestuff was washed off, so that the tow was only stained to a very light shade of color in each instance.

Example 1 was repeated again, except that the tow was padded with an aqueous solution of 25 g/L of C. I. Basic Red 29 dye (a water-soluble dye) containing 6 g/L of guar gum thickener, instead of the C. I. Disperse Violet 33 dye dispersion. After a total exposure time of 15 minutes at 165° C. the tow was washed with water. Most of the dyestuff was washed off, so that the tow was only stained to a very light shade of color.

What is claimed is:

1. A process for dyeing a tow of crystalline poly-(m-phenylene isophthalamide) filaments comprising the steps of:

padding onto the surface of the filaments of the tow an aqueous dispersion of 1 to 20 wt. % of a water-insoluble dye material having a dye-activation temperature at or less than about 130° C. and below the glass transition temperature of poly(m-phenylene isophthalamide), heating the tow with steam to a temperature below the glass transition temperature of the poly(m-phenylene isophthalamide) but above the dye-activation temperature to activate the dye material on the surface of the filaments of the tow, and thereafter heating the tow with steam to a temperature above the glass transition temperature of the poly(m-phenylene isophthalamide) but no more than about 165° C. to diffuse substantially all of the dye material into the filaments of the tow.

2. The process of claim 1 wherein an aqueous dispersion of 2 to 20 wt. % of a water-insoluble dye material is padded onto the surface of the filaments of the tow.

3. The process of claim 1 wherein the tow is heated to a maximum temperature of from about 150° to 165° C.

4. A process for dyeing synthetic fibers including the following steps:

contacting fibers of crystalline poly(m-phenylene isophthalamide) with an aqueous dispersion containing a water-insoluble dye which is activated in steam at a temperature below the glass transition temperature of the fibers, heating the fibers with steam at a dye-activation temperature at or less than about 130° C. and below the glass transition temperature of the fibers for a time sufficient to activate the water-insoluble dye on the surface of the fibers, and thereafter heating the fibers with steam at a temperature above the glass transition temperature of the fibers for a time sufficient to diffuse the dye material into the fibers.

5. The process of claim 4 wherein the fibers are heated with steam at a temperature of about 165° C.

6. The process of claim 4 wherein the crystalline poly(m-phenylene isophthalamide) fibers are dyed with the water-insoluble dye in less than 30 minutes, without the use of a carrier.

* * * * *